235-379 SR
12/27/83 OR 4,423,316

United States Patent [19] [11] 4,423,316
Sano et al. [45] Dec. 27, 1983

[54] AUTOMATIC BANKING SYSTEM

[75] Inventors: Zyunzi Sano, Otsu; Hideki Maeda, Kusatsu, both of Japan

[73] Assignee: Omron Tateisi Electronics Co., Kyoto, Japan

[21] Appl. No.: 303,103

[22] Filed: Sep. 17, 1981

[30] Foreign Application Priority Data

Sep. 24, 1980 [JP] Japan ..... 55-132720

[51] Int. Cl.[3] ..... G06F 15/30
[52] U.S. Cl. ..... 235/379; 235/375
[58] Field of Search ..... 235/379; 364/408

[56] References Cited

U.S. PATENT DOCUMENTS

| | | | |
|---|---|---|---|
| 3,896,290 | 7/1975 | Denaval | 364/408 |
| 3,943,335 | 3/1976 | Kinker et al. | 235/379 |
| 4,134,537 | 1/1979 | Glaser et al. | 235/379 |
| 4,172,552 | 10/1979 | Case | 235/379 |
| 4,270,042 | 5/1981 | Case | 235/379 |
| 4,321,672 | 3/1982 | Braun | 364/408 |

*Primary Examiner*—Harold I. Pitts
*Attorney, Agent, or Firm*—Cushman, Darby & Cushman

[57] ABSTRACT

An automated banking system in which registered numbers, each associated with a pair of transferer/transferee accounts, are stored in a file. To transfer funds a key is operated designating that a registered number is stored and the number then entered. The entered and stored numbers are then compared and the transaction authorized.

8 Claims, 31 Drawing Figures

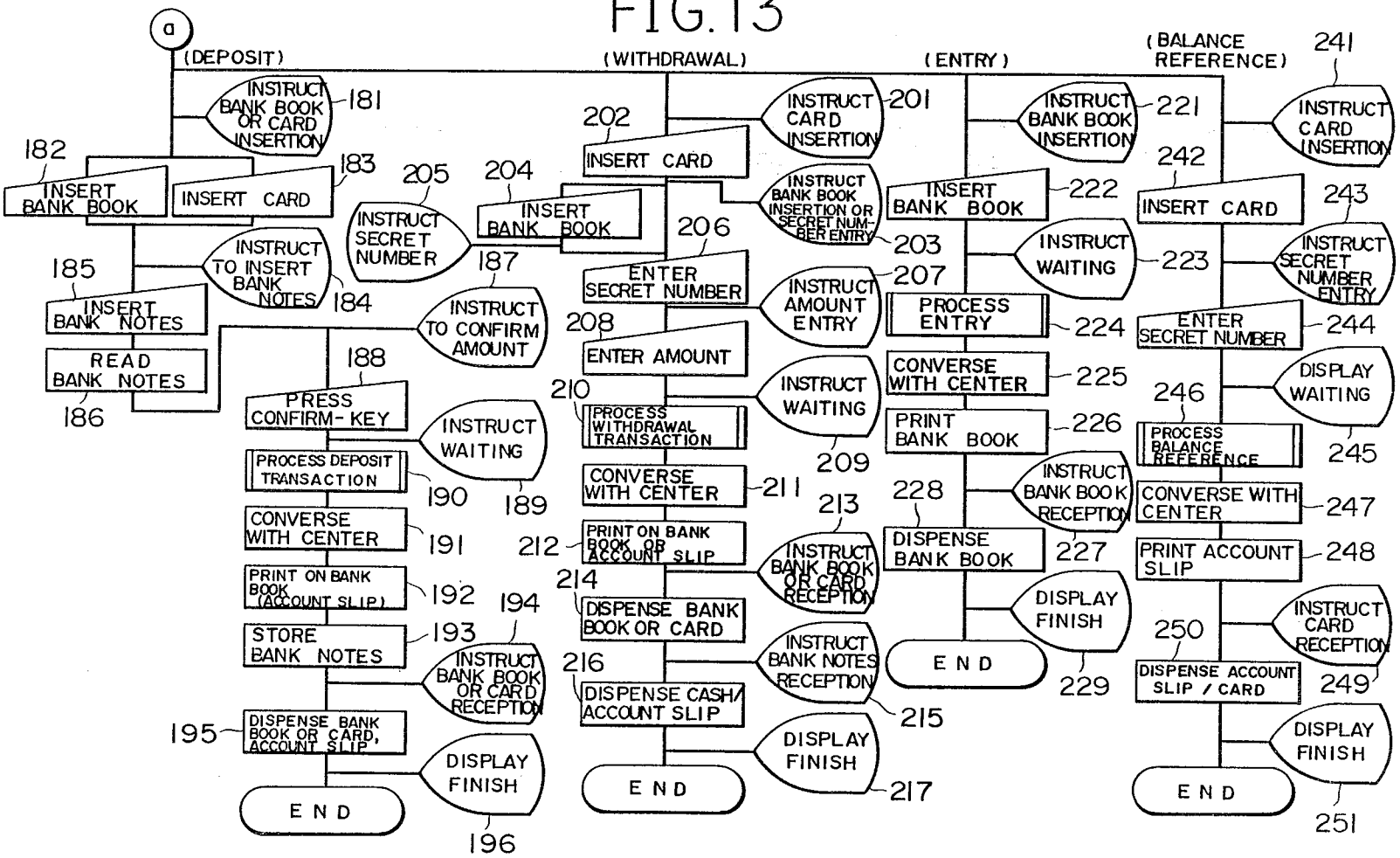
FIG. 13
(DEPOSIT)
(WITHDRAWAL)
(ENTRY)
(BALANCE REFERENCE)
a
INSTRUCT BANK BOOK OR CARD INSERTION
181
INSERT BANK BOOK
182
INSERT CARD
183
INSTRUCT TO INSERT BANK NOTES
184
INSERT BANK NOTES
185
READ BANK NOTES
186
INSTRUCT SECRET NUMBER
187
INSTRUCT TO CONFIRM AMOUNT
188
PRESS CONFIRM-KEY
189
INSTRUCT WAITING
190
PROCESS DEPOSIT TRANSACTION
191
CONVERSE WITH CENTER
192
PRINT ON BANK BOOK (ACCOUNT SLIP)
193
STORE BANK NOTES
194
INSTRUCT BANK BOOK OR CARD RECEPTION
195
DISPENSE BANK BOOK OR CARD, ACCOUNT SLIP
196
DISPLAY FINISH
END
INSTRUCT CARD INSERTION
201
INSERT CARD
202
INSTRUCT BANK BOOK INSERTION OR SECRET NUMBER ENTRY
203
INSERT BANK BOOK
204
INSTRUCT SECRET NUMBER
205
ENTER SECRET NUMBER
206
INSTRUCT AMOUNT ENTRY
207
ENTER AMOUNT
208
INSTRUCT WAITING
209
PROCESS WITHDRAWAL TRANSACTION
210
CONVERSE WITH CENTER
211
PRINT ON BANK BOOK OR ACCOUNT SLIP
212
INSTRUCT BANK BOOK OR CARD RECEPTION
213
DISPENSE BANK BOOK OR CARD
214
INSTRUCT BANK NOTES RECEPTION
215
DISPENSE CASH/ ACCOUNT SLIP
216
DISPLAY FINISH
217
END
INSTRUCT BANK BOOK INSERTION
221
INSERT BANK BOOK
222
INSTRUCT WAITING
223
PROCESS ENTRY
224
CONVERSE WITH CENTER
225
PRINT BANK BOOK
226
INSTRUCT BANK BOOK RECEPTION
227
DISPENSE BANK BOOK
228
DISPLAY FINISH
229
END
INSTRUCT CARD INSERTION
241
INSERT CARD
242
INSTRUCT SECRET NUMBER ENTRY
243
ENTER SECRET NUMBER
244
DISPLAY WAITING
245
PROCESS BALANCE REFERENCE
246
CONVERSE WITH CENTER
247
PRINT ACCOUNT SLIP
248
INSTRUCT CARD RECEPTION
249
DISPENSE ACCOUNT SLIP / CARD
250
DISPLAY FINISH
251
END

AUTOMATIC BANKING SYSTEM

BRIEF SUMMARY OF THE INVENTION

The present invention relates to an automatic banking system which provides for performance of a transaction by a bank user on a step by step basis, and more particularly to an automatic banking system which performs a transfer transaction.

Heretofore, in order to save much of routine service work of bank tellers and expand the breadth of services offered by a bank, there have been developed an automatic cash dispensing apparatus which performs a withdrawal transaction on reception of a card or a bank book recorded with a customer's personal code or secret number, an automatic depositing apparatus which performs deposits into bank accounts on acceptance of monies, an automatic cash depositing and dispensing apparatus which performs any one of withdrawal and deposit transactions at a customer's selection, and so forth. Moreover, an automatic banking apparatus has been suggested which would perform a transfer transaction for transferring funds from one account to another within a certain bank.

Any automatic banking apparatus or system which performs a transfer transaction between accounts in different banks, however, has not been put to use yet because the procedure of inputting data specifying a receipient's or transferee's account becomes complicated.

It is, therefore, a primary object of the present invention to provide an automatic banking system which practically performs transfer transactions between different accounts not only within the same bank but also in different banks with a simple designation of a transferee's bank account.

It is a further object of the present invention to provide an automatic banking system including means for storing a registered number file for identification of the transferee's bank account corresponding to a registered number entered into the system.

It is another object of the present invention to provide an automatic banking system including means for issuing a voucher printed with data representing the results of a specific transaction.

Other objects and numerous advantages of the automatic banking system according to the present invention will become apparent from the following detailed description of preferred embodiments shown on the accompanying drawings, in which:

BRIEF DESCRIPTION OF THE DRAWINGS

FIGS. 12A,12B and 13 are flow charts illustrating overall procedures for the automatic banking system.

DETAILED DESCRIPTION

Figure 1:
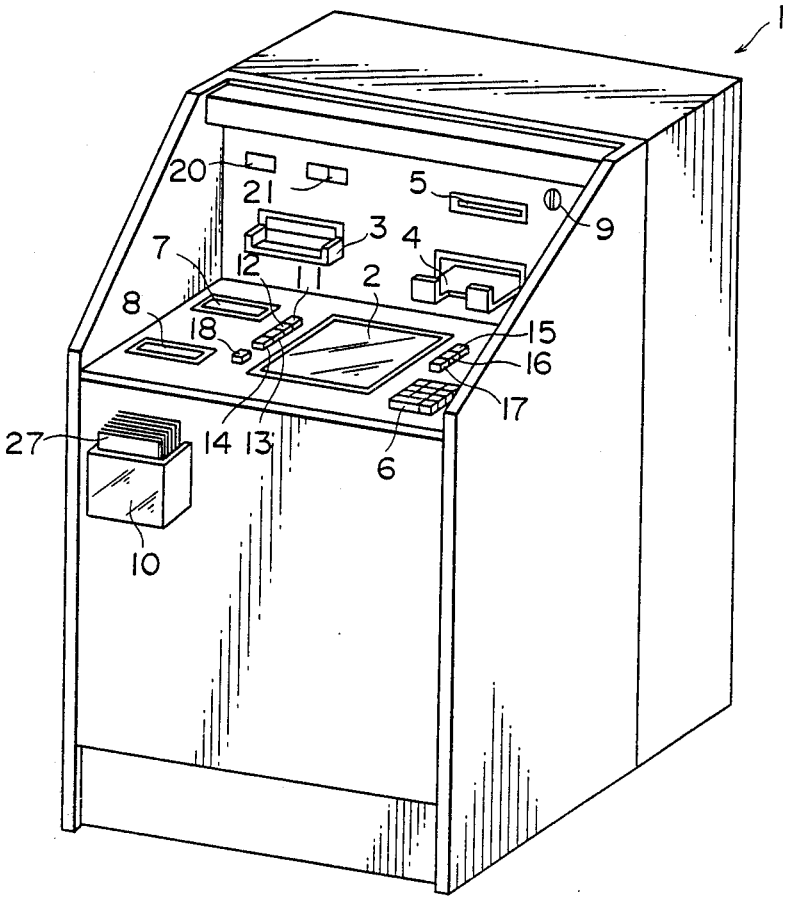
FIG. 1 is a perspective view showing the appearance of a transaction terminal employed in an automatic banking system of a preferred embodiment of the present invention.

Returning, now, to FIG. 1 there is shown the appearance of a transaction terminal 1 of an automatic banking system as a preferred embodiment of the present invention, which includes a forwardly projecting horizontal customer operation panel provided with a cathode-ray tube display (hereinafter briefly referred to as "CRT") 2. The CRT 2 is disposed to display instructive messages or diagrams to sequentially direct a user or customer as to the procedures to be performed by him, terms indicating functions of operation switches 11 to 18, withdrawal monetary amounts of cash to be dispensed, and other data or information for confirmation by the customer on operation. The display screen of the CRT 2 is covered with protective glass for safety. The operation switches 11 to 14, 18, and 15 to 17 are aligned along the opposite sides of the CRT 2. The operation switches 11 to 17 are used for entering the desired transaction selected by the customer (see FIG. 14), monetary units, such as dollars and cents, of withdrawal monies (see FIG. 18), the designation of his or other bank (see FIG. 19), the designation of registered or nonregistered transferee's account (see FIG. 20), the designation of a branch bank to be transferred (see FIG. 21), confirmation (see FIG. 25), and so forth. The switch 18 is used exclusively for entering the cancellation of a transaction (see FIG. 25). At the right-hand side of the CRT 2 there is disposed a ten-key keyboard 6 for entering numeric information, such as an identification number for identifying the customer, the monetary amount of funds to be transferred in a transfer transaction, the registered number, branch number, account number, withdrawal monetary amounts or the like. The operation panel is further formed with a cash inlet 7 for inserting bank notes and a cash return outlet 8 for returning bank notes Preferably the operation switches 11 to 18 and the ten-key keyboard 6 are made of pressure-responsive electroconductive rubber, whereby they can be made thinner and positioned fully closer to the CRT 2 and rendered easier to operate and more compact. The cancellation-only switch 18 may be modified to be non-exclusive in such a manner that when the switch 18 must be designated as a cancellation key, the term of cancellation is displayed at the position on the CRT 2 close to switch 18.

The terminal 1 has a vertical operation panel formed at the right-hand side thereof with a clerk key 9 for the bank clerk, a card inlet 5 for inserting a magnetic card having magnetically recorded therein a personal code or secret number assigned to the customer, and a cash outlet 4 for delivering the bank notes to the customer in a withdrawal transaction. At the left-hand side, the vertical panel has a bank book inlet 3 through which the customer inserts, or the terminal 1 dispenses, a bank book 26 and a voucher 27 which is used in a transfer transaction. Moreover, through said inlet 3, the terminal 1 dispenses a receipt 28 printed with the data of a transaction. Above the bank book inlet 3, there are disposed an operation indicator 20 for indicating that system 1 is in condition for transactions, and a service indicator 21 for lightening lamps indicating the kinds or types of transactions available as bank services.

The transaction terminal 1 further has at the lower portion of its front side a voucher box 10 for carrying a large number of sheets of unused vouchers 27. The vouchers 27 are used as customer's notes printed with details of the results of transfer transactions in such a manner that the voucher 27 is inserted into the bank book inlet 3 and dispensed therefrom after printing.

Figure 2:
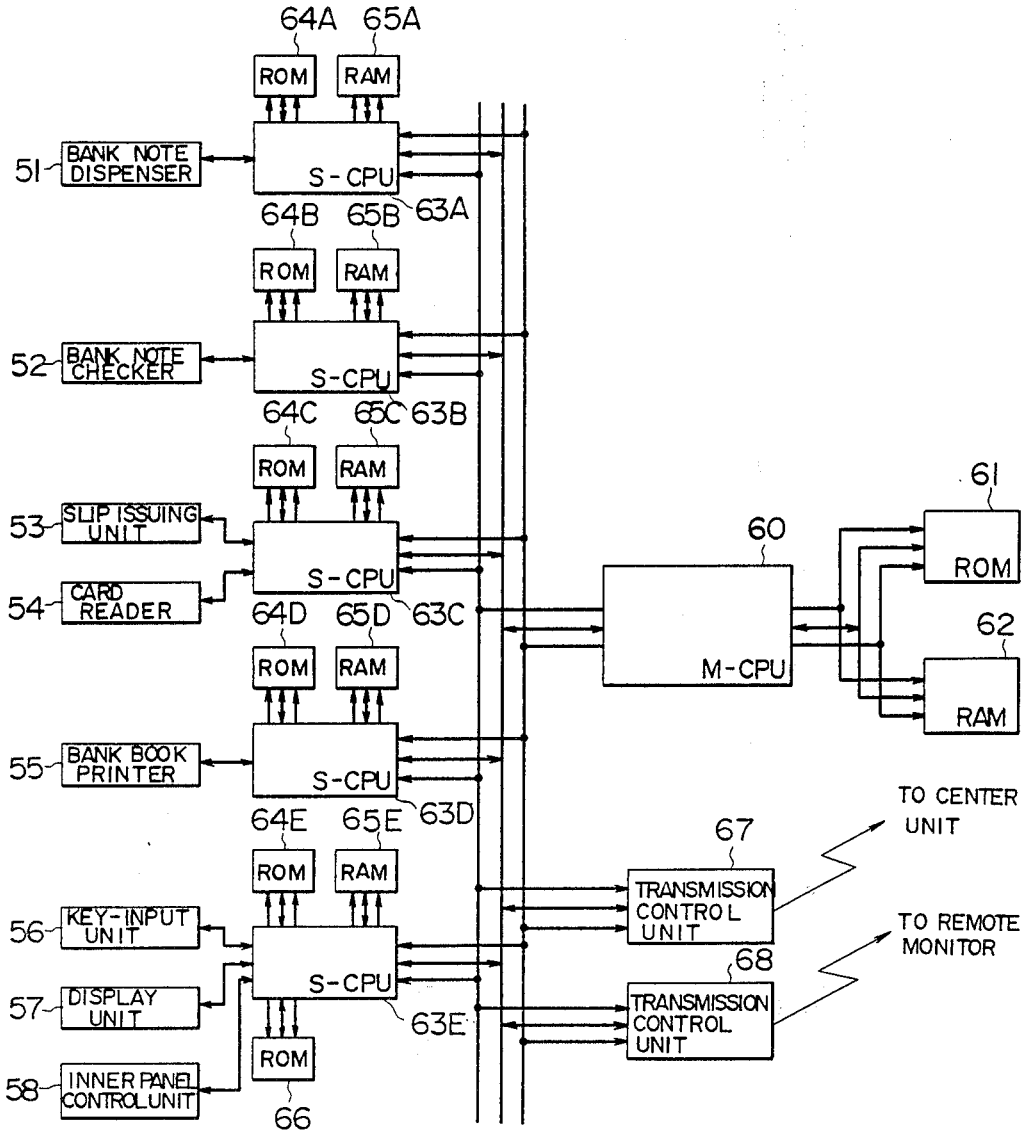
FIG. 2 is a block diagram showing an interior circuit of the terminal of FIG. 1.

FIG. 2 schematically shows an interior construction of the terminal 1. The terminal is provided with input-/output units consisting of a bank note dispenser 51 for counting and transporting bank notes in a sum specified for cash dispensing and delivering the notes to the cash outlet 4, a bank note checker 52 for verifying if the bank notes inserted into the cash inlet 7 are genuine and discriminating the denominations of the bank notes, a slip issuing unit 53 for recording on a slip as a bank's copy the data of each transaction, such as the kind of transaction, the monetary amount of funds to be dispensed or deposited and so forth, a magnetic card reader 54 disposed inside the card inlet 5 for reading data magnetically recorded in the card, a bank book register 55 for printing on bank book 26, voucher 27 and detailed account slip 28 the data of each transaction and reading the information data recorded on a magnetic strip adhered to a cover surface of the bank book or recording the desired data on the strip, a key-input unit 56 including the operation switches 11 to 18 and the ten-key keyboard 6, a display unit 57 including the CRT 2, and a control unit 58 disposed on an inner panel (not shown) of the terminal 1. The transaction terminal 1 is controlled by a master-and-slave system consisting of a master central processing unit (hereinafter referred to as "M-CPU") 60 and a plurality of slave central processing units (hereinafter referred to as "S-CPU") 63A to 63E. The bank note dispenser 51 is controlled by the S-CPU 63A, the bank note checker 52 by the S-CPU 63B, the slip issuing unit 53 and card reader 54 by the S-CPU 63C, the bank book printer 55 by the S-CPU 63D, and the key-input unit 56, display unit 57 and inner panel control unit 58 by the S-CPU 63E. The M-CPU 60 and the S-CPU 63A to 63E are coupled to program memories 61 and 64A to 64E having stored therein execution programs for each transaction of deposit, withdrawal, transfer and other transactions and to data memories 62 and 65A to 65E for writing and reading the data of transactions, respectively. The S-CPU 63 for controlling the display unit 57 is coupled to a message-diagram code memory 66 for storing various codes representing predetermined procedure instructive messages, instructive diagrams and function indication terms to enable the CRT 2 to present various displays. When a command is applied from the M-CPU 60 to the respective S-CPU 63A to 63E, the respective S-CPU 63A to 63E control their respective input-and-output units in accordance with the execution programs stored in the memories 64A to 64E to perform the operations designated by the above-mentioned command, and deliver to the M-CPU 60 the data made during execution of the operations. The transaction processing data in deposit, withdrawal and other transactions are delivered from the M-CPU 60 to a center unit (not shown) through a transmission control unit 67. Conversely, the center unit transmits information data to the M-CPU 60 via the transmission control unit 67. The states and troubles in the terminal that will be displayed in the above-mentioned inner panel are also displayed on a remote monitor (not shown). The communication between the monitor and the M-CPU 60 is effected by way of a transmission control unit 68. These transmission control units 67 and 68 include a line controller, modulation-demodulator and so forth.

Figure 3:
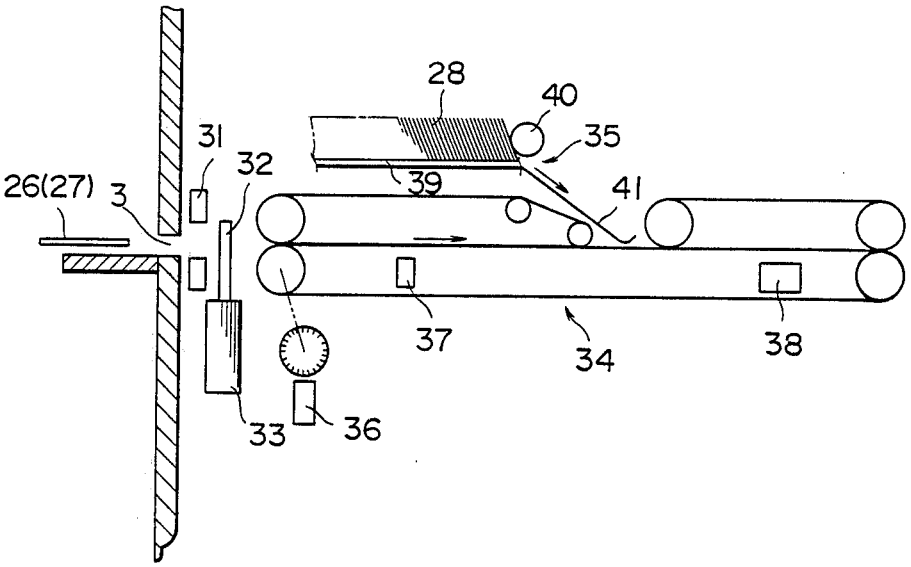
FIG. 3 is a schematic sectional view showing a bank book printer section employed in the circuit of FIG. 2.

In FIG. 3 there is schematically illustrated the bank book printer 55. Inside the terminal 1 adjacent to the bank book inlet 3 there are disposed an insertion detector 31 for detecting an insertion of bank book 26 or voucher 27, a shutter 32 and a plunger 33 for driving the shutter 32 to be opened or closed. Inwardly of this terminal from this section there is provided a main transport route 34 consisting of a plurality of pulleys and conveyer belts engaged with the pulleys for transporting bank book 26, voucher 27 or detailed account slip 28. In the transport route 34 there are disposed a line detector 36, code detector 37, printer 38, and sensors (not shown) for sensing a pointed end of the bank book, voucher or account slip. The line detector 36 is adapted to sense the revolution of one of the pulleys of the transport route 34 so as to detect the number of lines of the conveyed bank book. The printer 38 is adapted to print the bank book, voucher or account slip with transaction processing data to be printed and a print finish or end mark K4 that will be described later. The bank book printer 55 is further provided with a detailed account slip feeding unit 35 consisting of a holder 39 for holding a plurality of slips 28, a feeding roller 40 for feeding out the slips 28 one by one and a sub-transport route 41 for conveying the fed-out slips 28 to the main route 34. If any bank book is not inserted into the terminal 1 in deposit, withdrawal or transfer transaction, one of the detailed account slips 28 carried by the holder 39 is fed out to the main transport route 34 so as to be printed with predetermined processed data.

Figure 4:
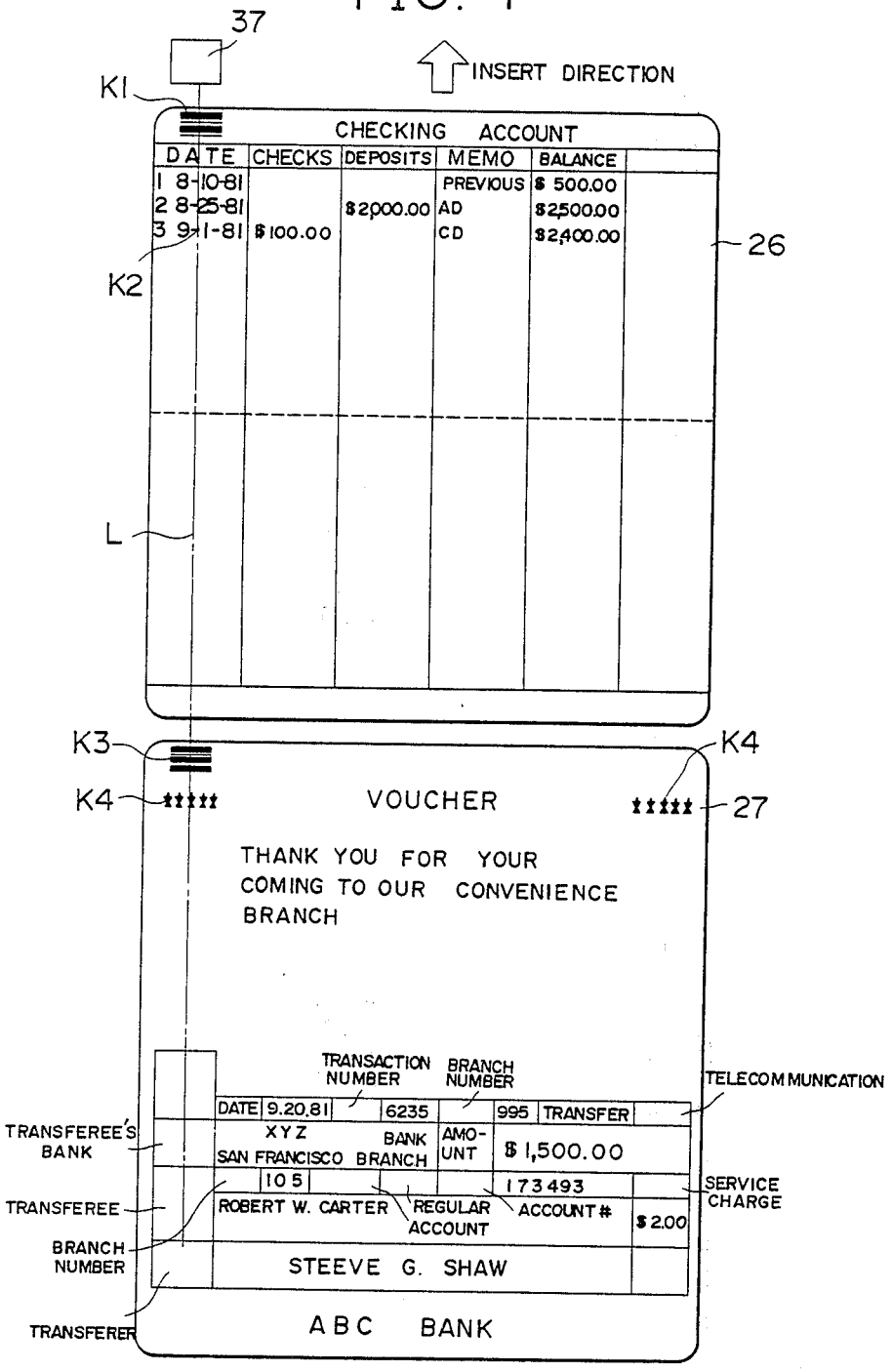
FIG. 4 illustrates a bank book and a voucher to be sensed by a code detector of FIG. 3.

FIG. 4 illustrates the details of bank book 26 and voucher 27 and the positional relation between the code detector 37 and the bank book 26 or voucher 27 conveyed in the transport route 34. The bank book 26 at an upper left-hand portion thereof is printed with a page code K1 consisting of bar codes representing a page number. The voucher 27 is provided with a print format to be printed with the transaction date, transferee, monetary amount of the funds to be transferred, transferee's name and transferer's name, and is at an upper left-hand portion thereof printed with a voucher code K3 representing that it is a voucher. The codes K1 and K3 will be positioned to occur just over a scanning line L of the code detector 37 when the bank book 26 and voucher 27 are conveyed in the transport route 34, respectively. The scanning line L also is crossed by hyphen marks K2 printed between months and days in the column of "DATE" of the bank book 26. In accordance with the printed hyphen marks K2, the next line to be printed is designated in position. After the voucher 27 is printed with predetermined information, it is printed, in alignment with the scanning line L, with a print end mark K4 by the printer 38. The end mark K4 is symmetrically printed as if it were a pattern. Thus, the page code K1 printed on the bank book 26, the hyphen mark K2 representing the printed line, the voucher code K3 printed on voucher 27 and the print end mark K4 printed on the same are sensed by the code detector 37 when such printed documents are transported to the detector by the transport route 34.

Figure 5:
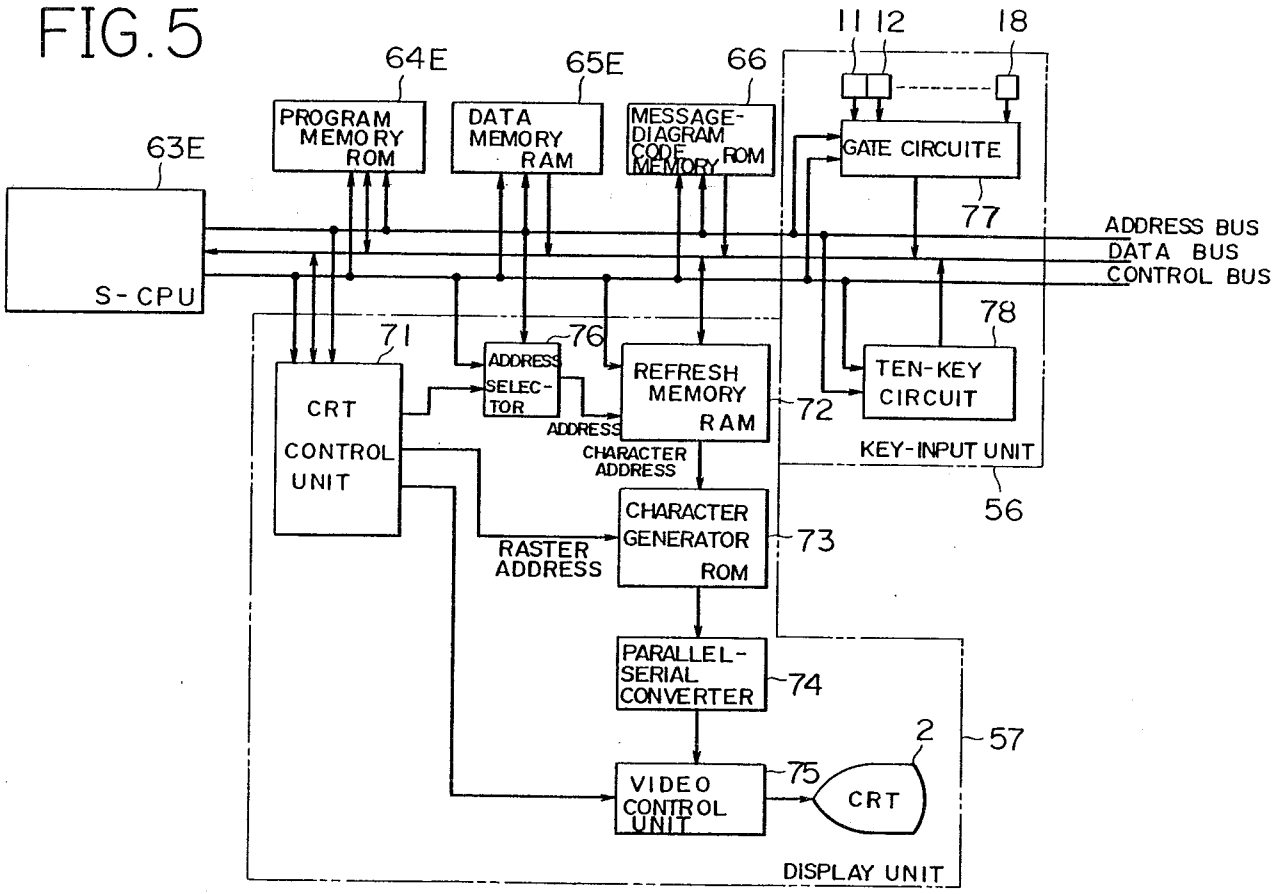
FIG. 5 is a block diagram showing a display unit and its associated units of the terminal of FIG. 2.

FIG. 5 illustrates the key-input unit 56, display unit 57, S-CPU 63E and the associated memories. The key-input unit 56 consists of the operation switches 11 to 18, gate circuit 77, ten-key keyboard 6 and ten-key circuit 78. The input signals entered into the respective switches 11 to 18 are applied to the S-CPU 63E through the gate circuit 77. The ten-key circuit 78 converts the input signals entered by the ten-key keyboard 6 into predetermined code signals, and the converted signals are delivered to the S-CPU 63E. The display unit 57 consists of a refresh memory 72, character generator 73, parallel-serial converter 74, video control unit 75, CRT 2, address selector 76 for the refresh memory 72, and CRT control unit 71. The refresh memory 72 is a random-access memory, and the character generator 73 is a read-only memory. The detailed contents and operations of the respective components of the display unit 57 will be described later.

The CRT 2 is adapted to display an operation instructive message, confirmation message, wait message, function indicating term, various terms, operation instructive diagram and function indication frame.

Examples of operation instructive messages are: "WELCOME TO OUR CONVENIENCE BRANCH" (see FIG. 14). "INSERT YOUR CARD IN THE DIRECTION OF ARROW" (see FIG. 15).

The confirmation message may for example be: "PLEASE CONFIRM THE FOLLOWING INFORMATION ON YOUR TRANSFEREE, AND PRESS 'CONFIRMATION' KEY" (see FIG. 25).

The waiting message may for example be: "PLEASE WAIT FOR A WHILE. WE ARE NOW UNDER PROCEDURE" (see FIG. 26).

Figure 14:
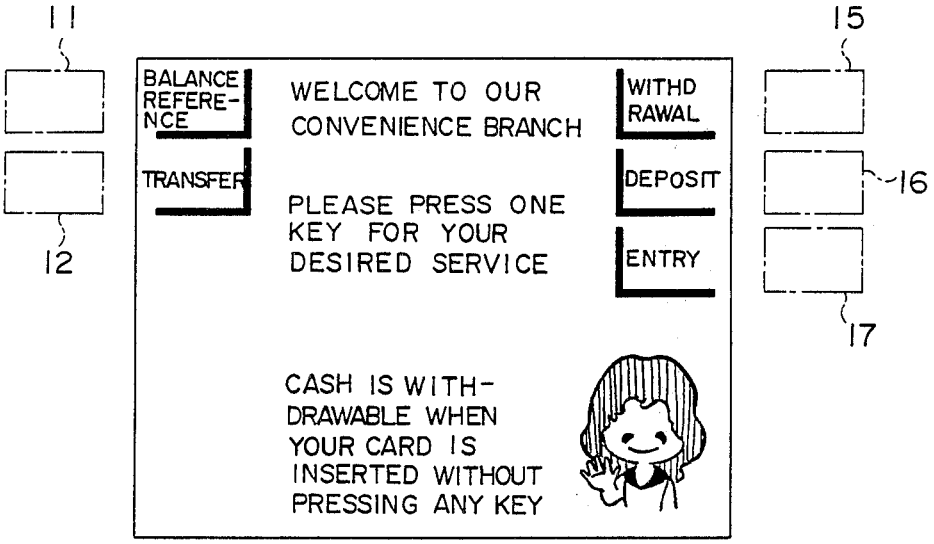
FIGS. 14 to 30 illustrate a series of typical pictures that may be displayed at a CRT display unit.

The function indicating terms indicate the functions of the operation switches 11 to 17, and include, among others, "BALANCE REFERENCE", "TRANSFER", "WITHDRAWAL", "DEPOSIT", "ENTRY" (see FIG. 14); "HUNDRED", "DOLLAR", "CENT" (see FIG. 18); "OUR", "OTHER" (see FIG. 19); "REGISTERED", "UNREGISTERED" (see FIG. 20); "DESIGNATION" (see FIG. 21); "SAVING", "CHECKING" (see FIG. 22); and "CONFIRMATION" (see FIG. 25). The various vocabulary terms are "BANK'S NAME", "BRANCH NAME", "TYPE", "ACCOUNT #", "TRANSFEREE", "TRANSFERED AMOUNT" (see FIG. 25). The operation instructive diagrams are diagrams which illustrate the operations to be taken by the customer in accordance with the corresponding operation instructive messages, such as the diagrams illustrating that a card is inserted into the card inlet 5 (see FIG. 15), that a bank book is inserted into the bank book inlet 3 (see FIG. 16) and so forth. These operation instructive diagrams may include any other illustrations which will be attractive to the customer. The above-mentioned function indication frames are the L-shaped frames surrounding the function indicating terms which are displayed on the CRT 2 at the positions corresponding to the operation switches 11 to 17.

The picture frame of the CRT 2 is divided into "m×n" picture element sections consisting of "m" columns and "n" rows so as to display the above-mentioned messages, terms, diagrams and frames. These picture element sections are provided with addresses of "0" to "m−1" and "0" to "n−1". Each of the sections consists of a large number of points, e.g. "24 by 16" bits. Characters composing a message consist of large characters each of which is displayed in a plurality of picture element sections and small characters each of which is displayed in a single picture element section. Each diagram is displayed by a combination of a plurality of diagram element groups. The respective diagram element groups are the same sizes as those of picture element sections. The diagram element group includes a plurality of diagram elements which are formed by dividing the picture element section into a plurality of vertical and horizontal portions. Each diagram element consists of a plurality of bits, e.g. "8 by 8" bits. A great variety of diagram element groups are formed by combining the lit diagram elements on the CRT 2. These characters and diagram element groups composing messages and diagrams are encoded so as to be stored in the character generator 73 in advance. Each of picture element sections consists of dots of "24 by 16" bits, and the respective character and diagram element group codes are constituted with $24\times16=384$ bits. The storage area for each of the codes is designated by an address so as to correspond to a picture element section of the CRT 2. Every 16 bits horizontally arranged in the storage areas are designated by twenty four raster-addresses.

For the convenience of explanation, in this embodiment, the large character is displayed on a plurality of sections, the small character is displayed on a single section, and each diagram element group is of the same size as one of the picture element sections. If desired, the sizes of the characters and diagram element groups may be modified so as to perform a more delicate or a coarse display.

Figure 6:
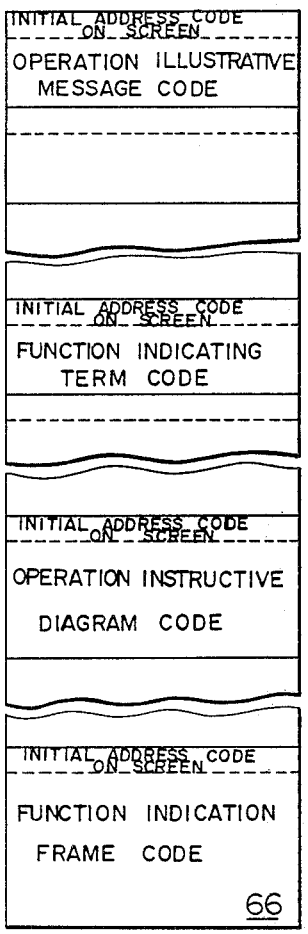
FIG. 6 illustrates the contents of a message, term and illustration code memory of FIG. 5.

In FIG. 6, there are schematically illustrated storage areas of the message diagram code memory 66. The above-mentioned messages and diagrams are encoded, and stored in the memory 66 as coded data in advance. The memory 66 includes the storage areas for storing operation illustrative message codes, function indicating term codes, operation instructive diagram codes, and function indication frame codes. It further includes the storage areas for confirmation display message codes, wait instruction message codes, and various vocabularly term codes, which are not illustrated in the drawings. These codes consist of the codes for the forefront ones of the addresses in the above-mentioned picture element sections on the CRT 2 to display the respective messages and diagrams, and the codes for diagram element groups or characters to construct the respective messages. The codes for characters and diagram element groups are arranged in the order of addresses of the picture element sections to be displayed. For these codes, it is desirable to use the addresses of storage areas of the character generator 73 for storing the respective characters and diagram element groups.

Figure 7:
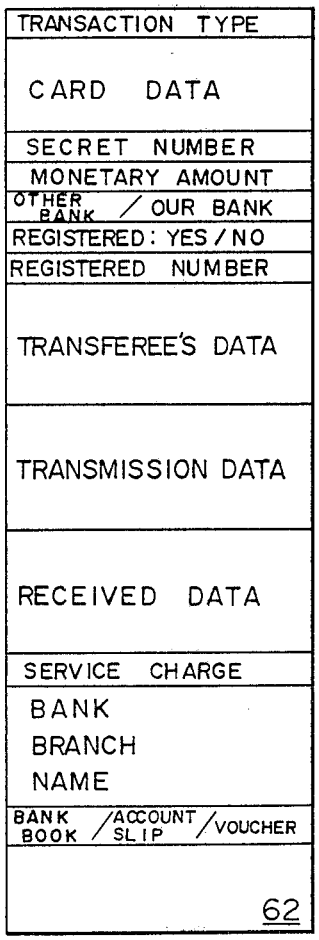
FIG. 7 illustrates the contents of a data memory of the terminal of FIG. 2.

In FIG. 7, there are illustrated the contents of the data memory 62. The memory 62 has an area for storing the kinds or types of transactions processed by the automatic banking system 1, an area for storing the card data read from a card by the card reader 54, an area for storing the secret numbers, various monetary amounts and registered numbers which are entered through the ten-key keyboard 6 into the terminal, an area for memorizing whether the transferee's bank designated through the operation switches 11 and 15 by the customer is the bank of the transaction terminal operated by him or another bank (see FIG. 19), an area for memorizing whether the transferee is registered as described in detail later, an area for storing the information data as to the transferee designated by the card or operation switches, an area for storing the transmission data and the receiving data for conversing with the center unit, an area for storing the service charge for transfer transaction, an area for storing the data transmitted from the center unit with respect to the transferee's bank name, branch name and personal name, and an area for memorizing whether transaction processed data have been printed on bank book, detailed account slip or voucher. These data are stored in the corresponding storage areas of the RAM 62 when they are delivered from the input-output units shown in FIG. 2 or transmitted from the center unit, and, if needed, further transferred to the respective RAMs 65A to 65E.

The respective displays on the CRT 2 are performed by the executing programs stored in the program memory 64E. The programs include commands to designate the messages or diagrams to be displayed. The S-CPU 63E decodes the commands so as to read out the codes of the messages or diagrams designated by the commands from the message-diagram code memory 66 and write them into the refresh memory 72. The refresh memory 72 consists of a first storage for storing the data of a first picture and a second storage for storing the data of a second picture which will be subsequent to the first picture on display. The first and second storages each has m×n storage areas corresponding to the picture element sections of the CRT 2. By thus writing into the refresh memory 72 from the memory 66 in accordance with the above-mentioned commands, the memory 72 at the storage areas corresponding to the respective picture element sections is written with the codes for characters or diagram element groups to be displayed in the sections, viz., the addresses of the character generator 73 storing the characters or diagram element groups. The addresses of the storage areas to be written with the respective codes in the refresh memory 72 are designated by the address selector 76 in response to the address signals developed from the S-CPU 63E.

If predetermined codes for display of a certain picture are written into the refresh memory 72 or have been already written into the first and second storages thereof, a read-out instruction is delivered from the S-CPU 63E to the CRT control unit 71 so as to apply the instruction read from the CRT control unit 71 to the address selector 76. Then, the respective codes written in the storage areas of the refresh memory 72 are read out in accordance with the address designation developed from the address selector 72. Since the codes stored in the respective storage areas of the refresh memory 72 are the addresses specifying a storage area of character generator 73 storing the characters or diagram element group to be displayed, the read out respective codes designate the addresses in the character generator 73. The CRT control unit 71 also delivers a raster address designation signal to the character generator 73 so as to sequencially read the characters or diagram element groups, each consisting of 24 by 16 bits, stored in the character generator. The read out data from the generator 73 are converted into time-shared serial video signals by the parallel-serial converter 74 for application to the video control unit 75. The video signals are scanned horizontally and vertically by the control unit 75 so that a predetermined picture may be displayed on the CRT 2. The CRT control unit 71 synchronizes the operations for reading data from the refresh memory 72, designating a raster address for the character generator 73 and scanning a video signal by the video control unit 75 with a predetermined timing.

Figure 8:
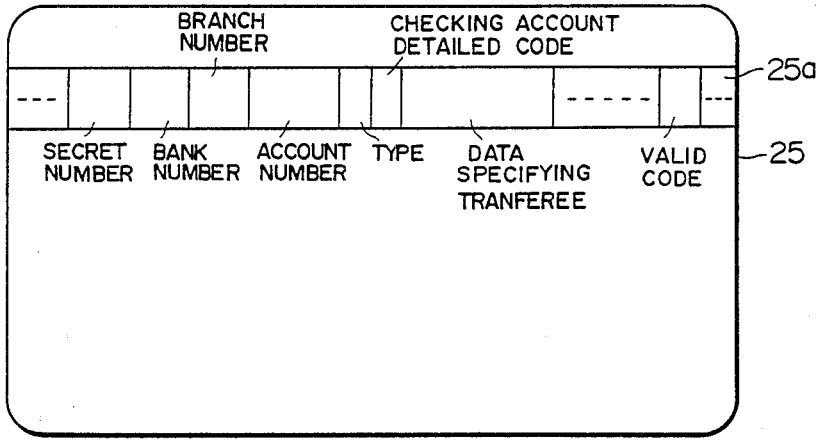
FIG. 8 illustrates a card recorded with card data.

FIG. 8 illustrates a card to be used in the transaction terminal 1. Two kinds of cards are provided. One of them is used for a deposit, withdrawal or other ordinary transaction and the other is used exclusively for a transfer transaction. In this embodiment, however, the ordinary card also may be used for a transfer transaction by the terminal 1. Every card 25 is provided with magnetic strips 25*a*, each of which stores therein a secret or identification number assigned to the card user, his bank, branch and account numbers, and a type code representing one of the kinds of checking, saving, credit card saving and other accounts. The strip 25*a* further stores therein a checking account detailed code representing whether if the card is an ordinary card, the card may be independently used in a transaction or is to be used together with a bank book. If the card is the above-mentioned transfer card, the checking account detailed code consists of a code representing that the card should be exclusively used for a transfer transaction, a code representing if a transferee's account is registered, and a code representing whether if it is registered, the data as to a transferee are vailable or not. If the codes represent such registration and availableness as to transferee's data, the strip 25*a* further stores therein data specifying a transferee, such as the transferee's bank number, branch number, account number and its type. The card 25 still further stores therein a valid code identifying if the card is valid. If available, the registered numbers of transferees may be recorded in the card 25.

Figure 9:
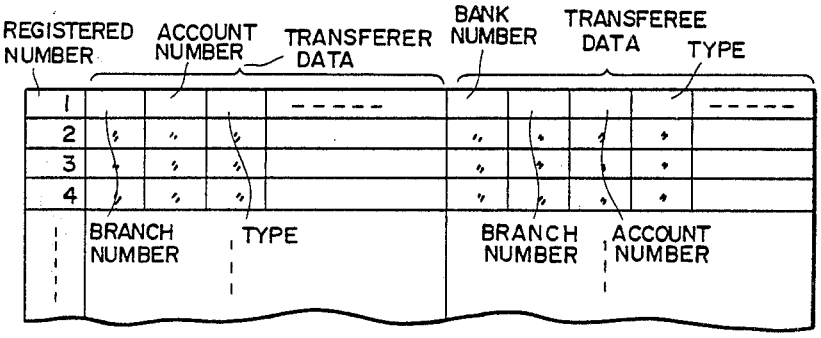
FIG. 9 illustrates the contents of a registered number file.

In this embodiment, there is provided a registration system in order to make the designation of transferees in transfer transactions faster and simpler. That is, a registration number file is prepared in the center unit of the automatic banking system of the terminal 1. In the registration number file, there are registered a plurality of pairs of transferer's and transferee's accounts, each pair being assigned a registered number. If a transferer has two or more transferees, different registered numbers are registered for each transferee. As schematically illustrated in FIG. 9, in the registration number file, there are recorded transferer's data, such as the transferer's bank branch number, account number, the type of the account, personal name, home address and so forth, and the transferee's data, such as the transferee's bank number, bank branch number, account number, account type, personal name, home address and so forth, for each registration number. In this embodiment, if a transferee's account belongs to the same bank as that of transferer's account, a transfer transaction to the transferee can be performed without registration in the registration number file. If the transferee has his account in another bank, such a transfer transaction cannot be performed without such registration.

Figure 10:
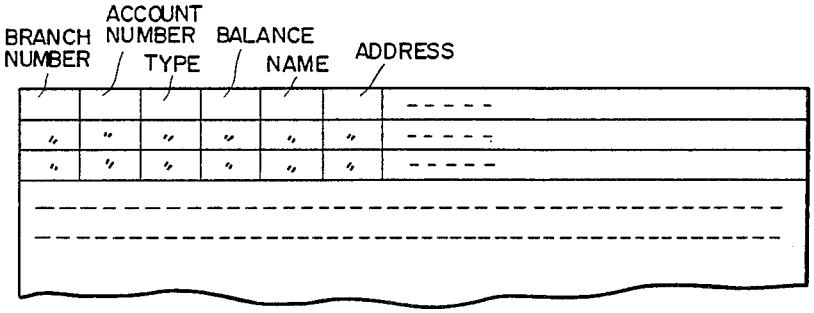
FIG. 10 illustrates the contents of a customer information file.

FIG. 10 schematically illustrates a customer information file (CIF) registered in the center unit of the system. Each of affiliated banks has such a customer information file in which there are recorded all information as to the customers who have their accounts in the bank. That is, for each customer, there are recorded in the CIF the branch number in which his account is filed, his account number, type of his account, balance of his account, his name and address, information to be printed on his bank book and so forth.

The transaction terminal 1 is coupled not only to the center unit of the bank managing the terminal 1 on an on-line basis, but also to a center unit of another affiliated bank on an on-line basis through the former center unit.

Figure 12A:
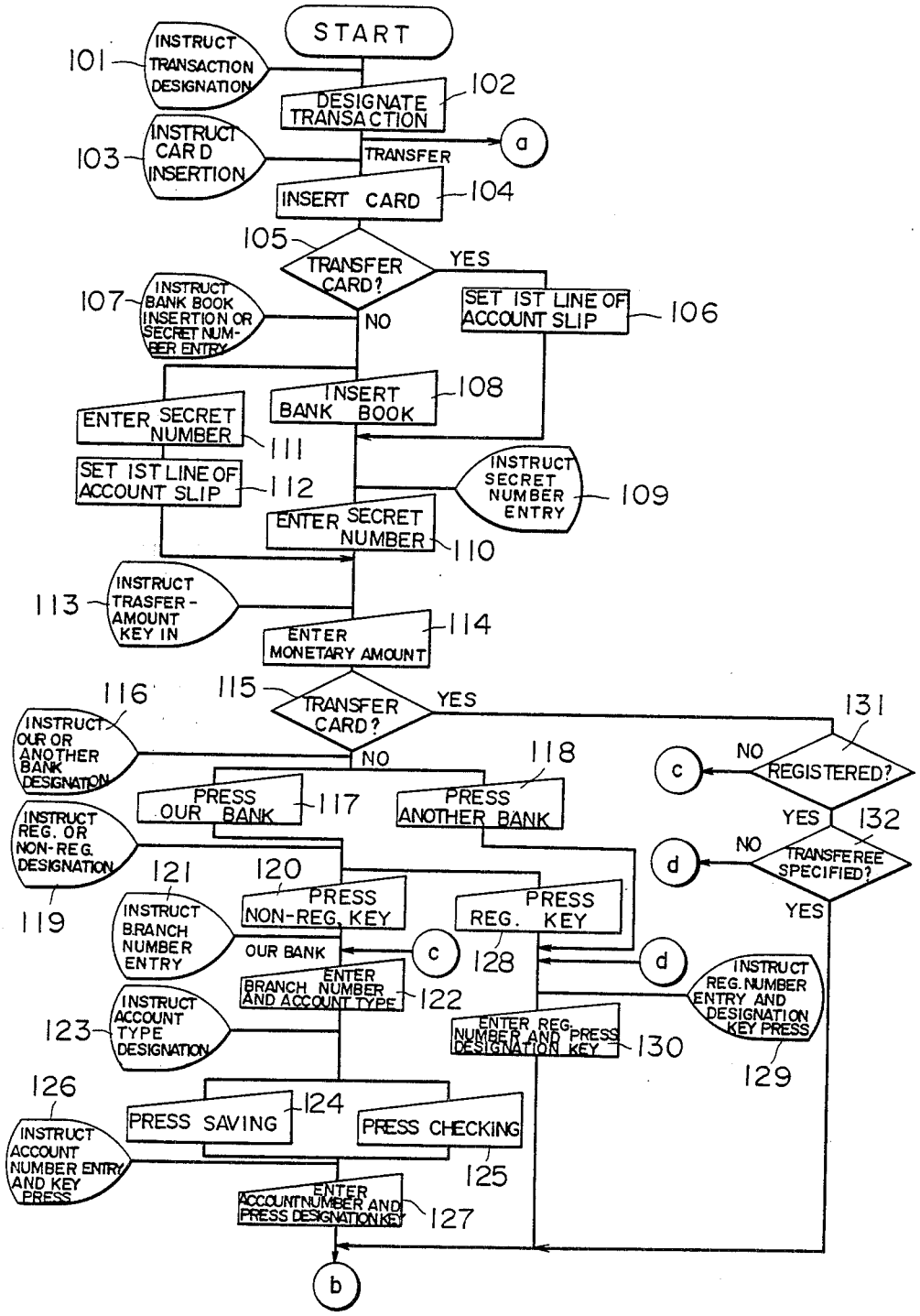
Figure 12B:
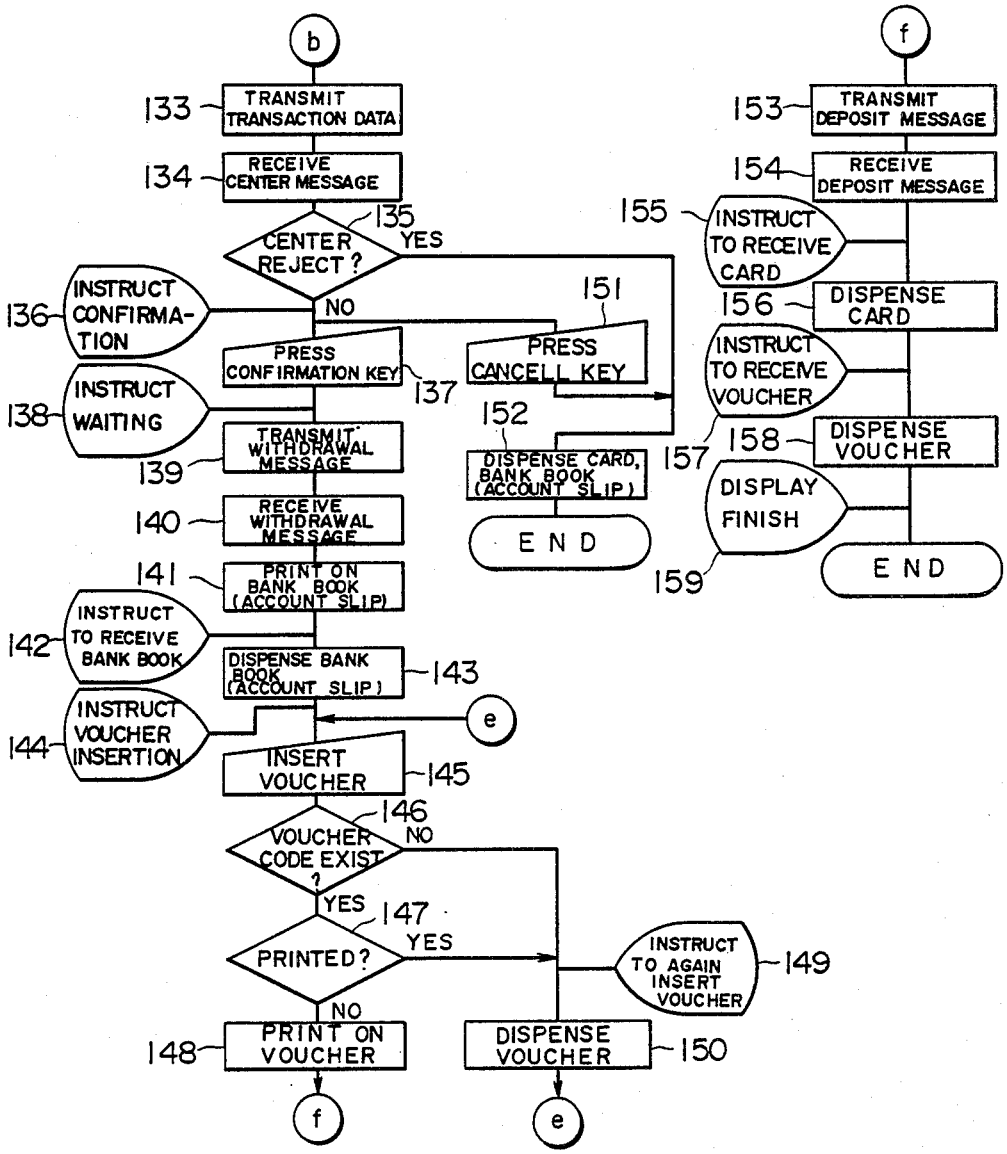

FIGS. 12A and 12B illustrates the steps to be taken in a transfer transaction in the terminal 1. Initially, an instructional message as illustrated in FIG. 14 is displayed on the CRT 2 to instruct a customer to designate the type of his desired transaction (step 101). As illustrated in FIG. 14, the operation switch 11 is used for specifying a balance reference or inquiry, the switch 12 for specifying a transfer transaction, the switch 15 for specifying a withdrawal transaction, the switch 16 for specifying a deposit transaction, and the switch 17 for specifying an entry to his bank book. Then, if the customer presses one key of the switches 11, 12 and 15 to 17 in order to designate his desired transaction (step 102), the sequence flows to steps to perform the designated transaction.

Figure 15:
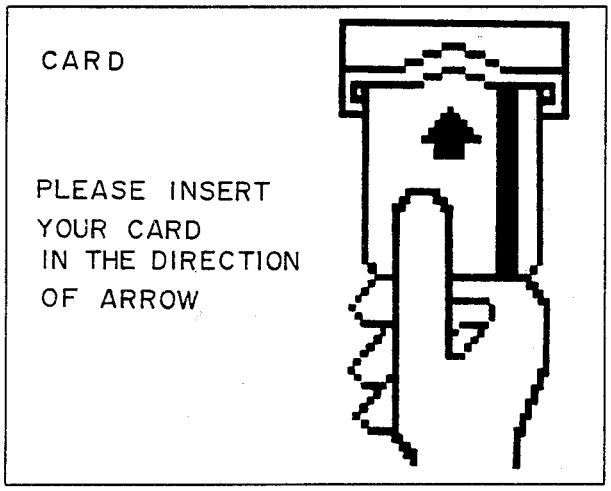
Figure 16:
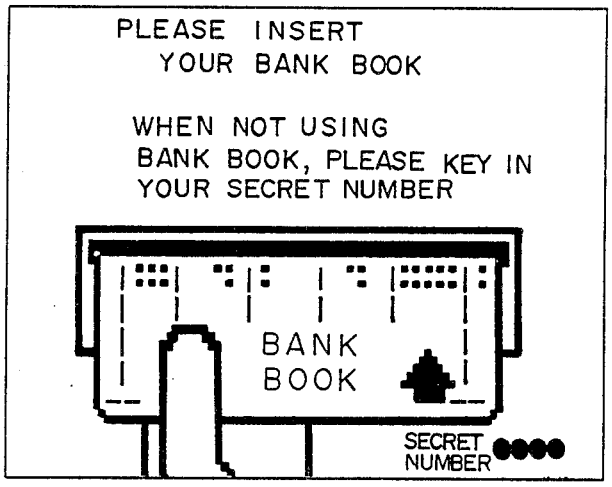
Figure 17:
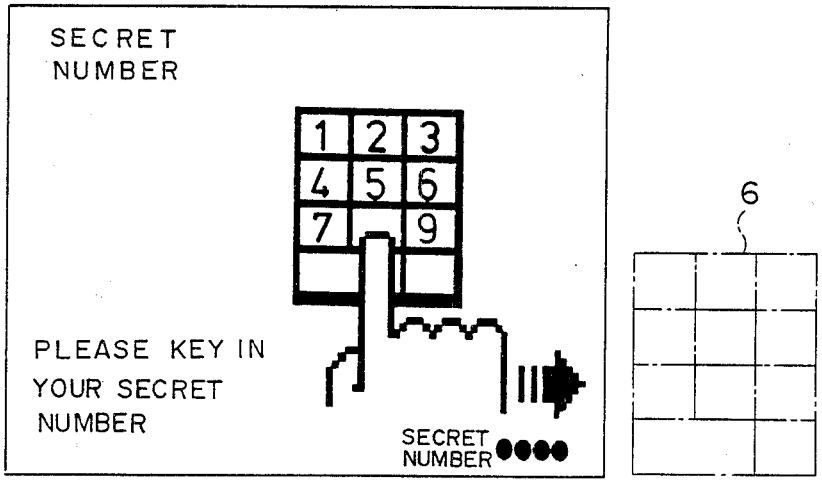

On his designation in the step 102, the sequence flows to a step 103 in which an operation instructional message with an instructional diagram is displayed on the CRT 2 so as to instruct the customer to insert his card as illustrated in FIG. 15. Then, if he inserts his card as instructed (step 104), it is inquired if the inserted card is a transfer exclusive-use card by reading card data from the inserted card (step 105). If the card is a transfer card, any bank book is not necessary and one of detailed account slips 28 is fed out by the slip feeding unit 35 from the holder 39 to the main transport route 34 so as to be set in such a manner that a first line of the fed out slip 28 to be printed confronts the printer 38 (step 106). If the card is not a transfer card but an ordinary card, an instructive message is displayed on the CRT 2 to instruct the customer to insert his bank book or enter his secret number or IA number (see FIG. 16)(step 107). If his bank book is inserted into the bank book inlet 3 (step 108), it is conveyed to a predetermined position by the transport route 34. Then, an instructive message (see FIG. 17) is displayed on the CRT 2 to instruct the customer to enter his secret number (step 109). If his secret number is entered through ten-key keyboard 6 (step 110), it is inquired if the entered number coincides with the number recorded in the magnetic strip of the inserted bank book. Unless the coincidence exists, an instructive message is displayed to instruct him to enter his secret number again. If the coincidence exists, the sequence flows to the next step. The sequence after the step 106 also advances to the step 109. Then, if his secret number is entered, it is inquired if the entered number coincides with the secret number in the card data recorded in the inserted card. If his secret number is entered after the step 107 has been performed (step 111), it is inquired if a coincidence exists between the entered secret number and the secret number recorded on the inserted card. If the coincidence exists, detailed account slip 28 is set in the same manner as that of the step 106 (step 112).

Figure 18:
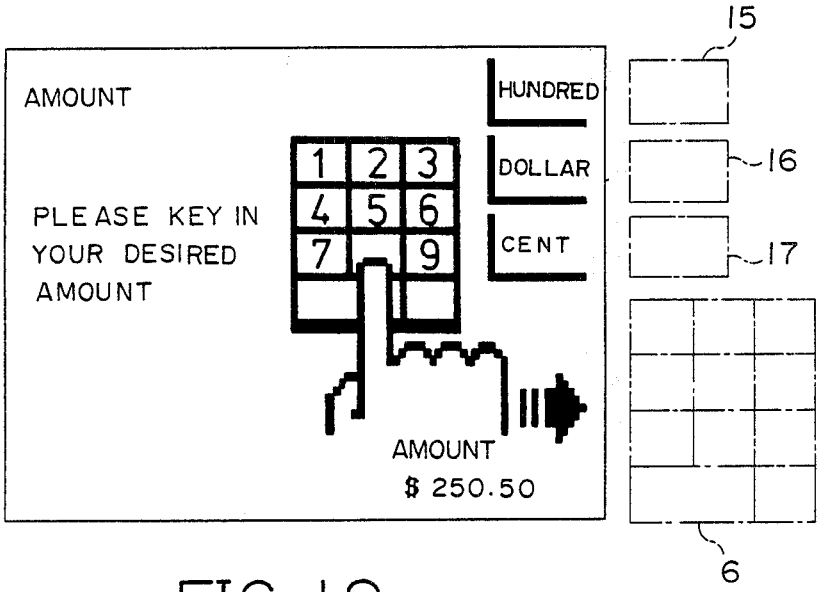

Subsequently, an instructive message (see FIG. 18) is displayed on the CRT 2 to instruct the customer to enter the monetary amount of funds to be transferred (step 113). As shown in FIG. 18, the operation switches 15, 16 and 17 are used for specifying "HUNDRED", "DOLLAR" AND "CENT". If the customer enters his desired amount of the funds through the ten-key keyboard 6 and switches 15 to 17 watching such a display shown in FIG. 18 (step 114), it is again inquired if the inserted card is a transfer card to be exclusively used for transfer transactions (step 115). The display of FIG. 18 includes a display of the entered transfer amount at a right-hand lower portion of the CRT 2.

Figure 19:
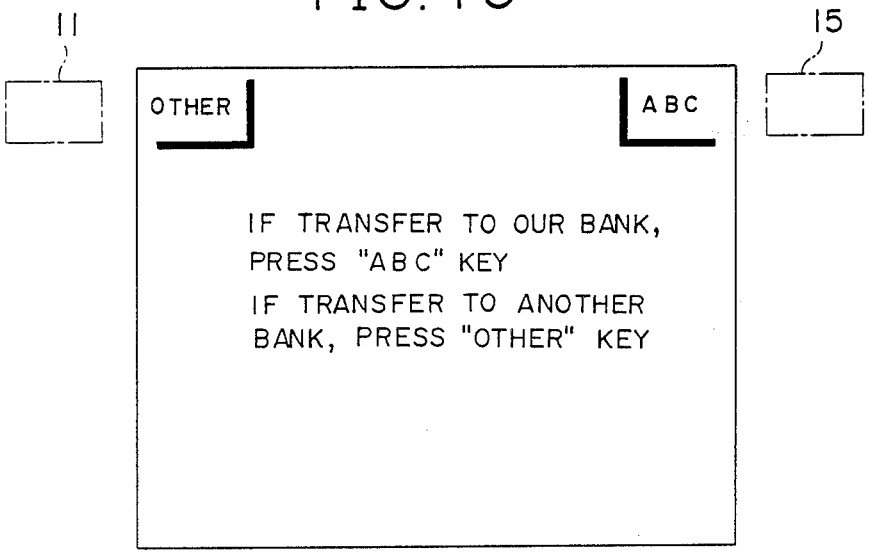
Figure 20:
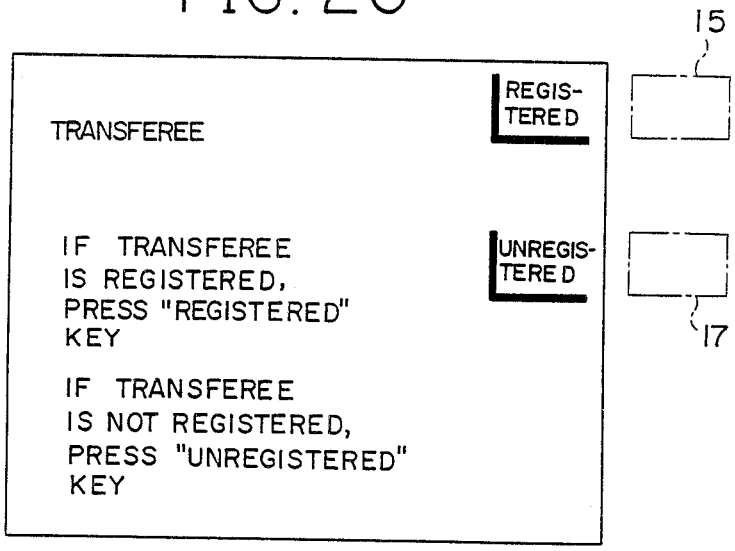
Figure 21:
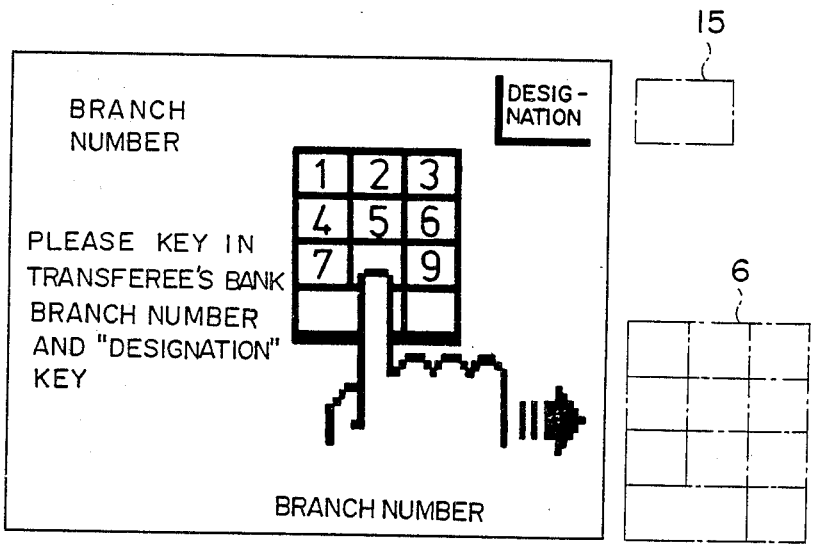
Figure 22:
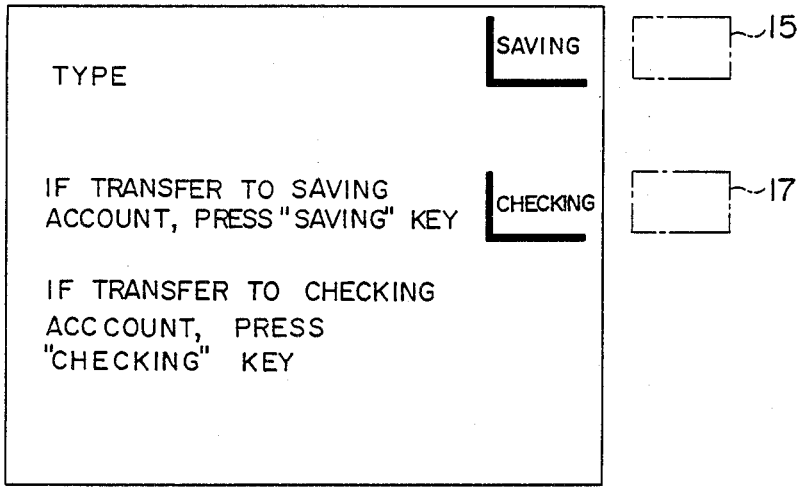
Figure 23:
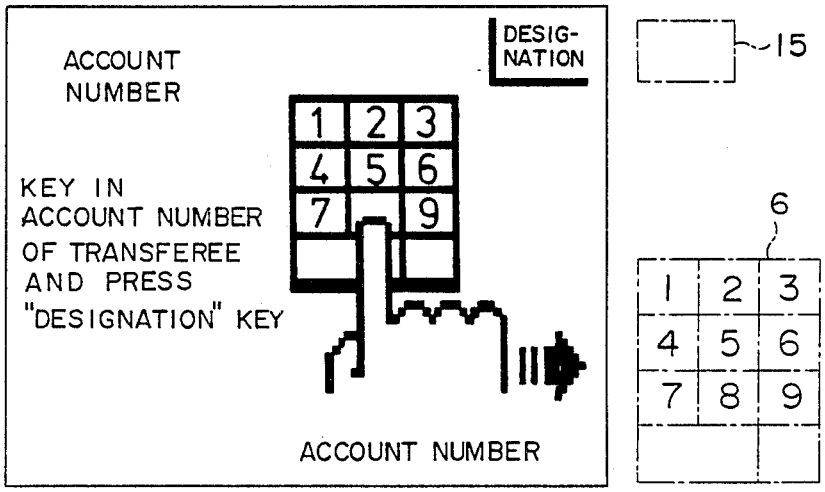

If the inserted card is verified as an ordinary card, viz. a "No" response is made, in the step 115, an instructive message shown in FIG. 19 is displayed on the CRT 2 to instruct the customer to designate whether he wants to transfer the funds to an account in his bank (ABC bank) or in another bank (step 116). The switches 11 and 15 are used for specifying another bank and his bank, respectively. If he designates his bank by pressing the key of the switch 15 (step 117), an instructive message shown in FIG. 20 is displayed on the CRT 2 to confirm the customer if the transferee's account is registered (step 119). In the step 119, the switches 15 and 17 are used for entering the information "registered" and "unregistered", respectively. If the customer presses the key of the switch 17 to enter the information that his transferee's account is not registered (step 120), an instructive message shown in FIG. 21 is displayed on the CRT 2 to instruct the customer to enter the branch number of the branch managing his transferee's account through the ten-key keyboard 6 and press the switch 15 designated as a designation key (step 121). A list panel (not shown in the drawings) listing the branch names and the branch numbers of his bank is put up by the terminal 1. If the customer reads the displayed list panel and inputs a branch number (step 122), an instructive message shown in FIG. 22 is displayed on the CRT 2 to designate whether the transferee's account is a saving account or a checking account (step 123). If he designates the saving account or checking account by pressing the switch 15 or 17 (step 124 or 125), an instructive message illustrated in FIG. 23 is displayed on the CRT 2 to instruct him to enter the account number of his transferee's account and press the switch 15 as a designation key (step 126). If he enters the account number in accordance with the instructive message (step 127), the operations for entering all information for specifying the transferee's account will be finished.

Figure 24:
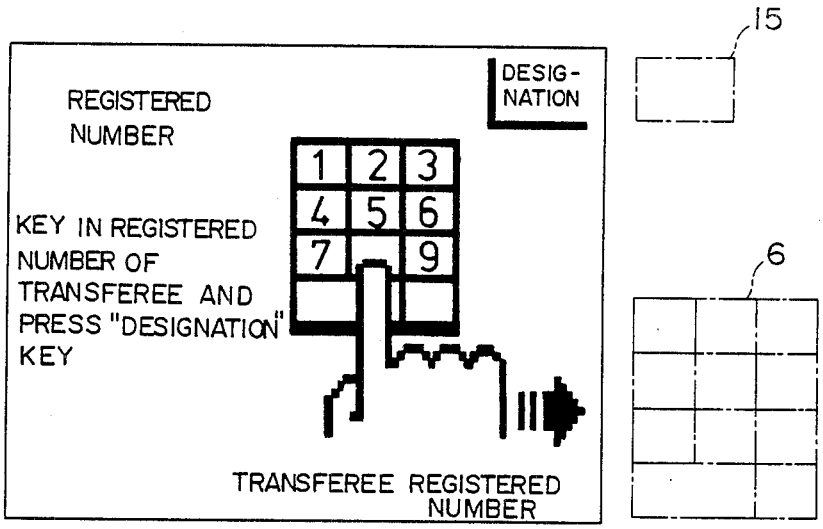

If the switch 15 specifying that the transferee is registered is pressed after the display in the step 119 by the customer (step 128), an instructive message as illustrated in FIG. 24 is displayed on the CRT 2 to instruct the customer to enter the registered number of the transferee through the ten-key keyboard 6 and push the designation key 15 (step 129). If he enters the registered number after reading the message (step 130), the sequence flows to its subsequent steps.

If he presses the switch 11 specifying that the transferee's account is opened in other bank after the display in the step 116, the sequence flows to a step 129 in which the customer is instructed to enter the registered number of the transferee.

If the inserted card is verified as a transfer card in the step 115, it is inquired by reading the card data recorded in the card if the transferee is registered (step 131). Unless it is registered, the sequence flows to step 121 in which the customer is instructed to enter the branch number, the account type and the account number with respect to the transferee. On a "YES" response to the step 131, it is inquired if there are the data specifying the transferee (step 132). On a "NO" response to the step 132, the sequence flows to step 129 in which the customer is instructed to enter the registered number. If the data specifying the transferee exist in the read card data, the sequence flows to its subsequent step 133 without any processing because the specifying data can be used as they are.

Figure 11:
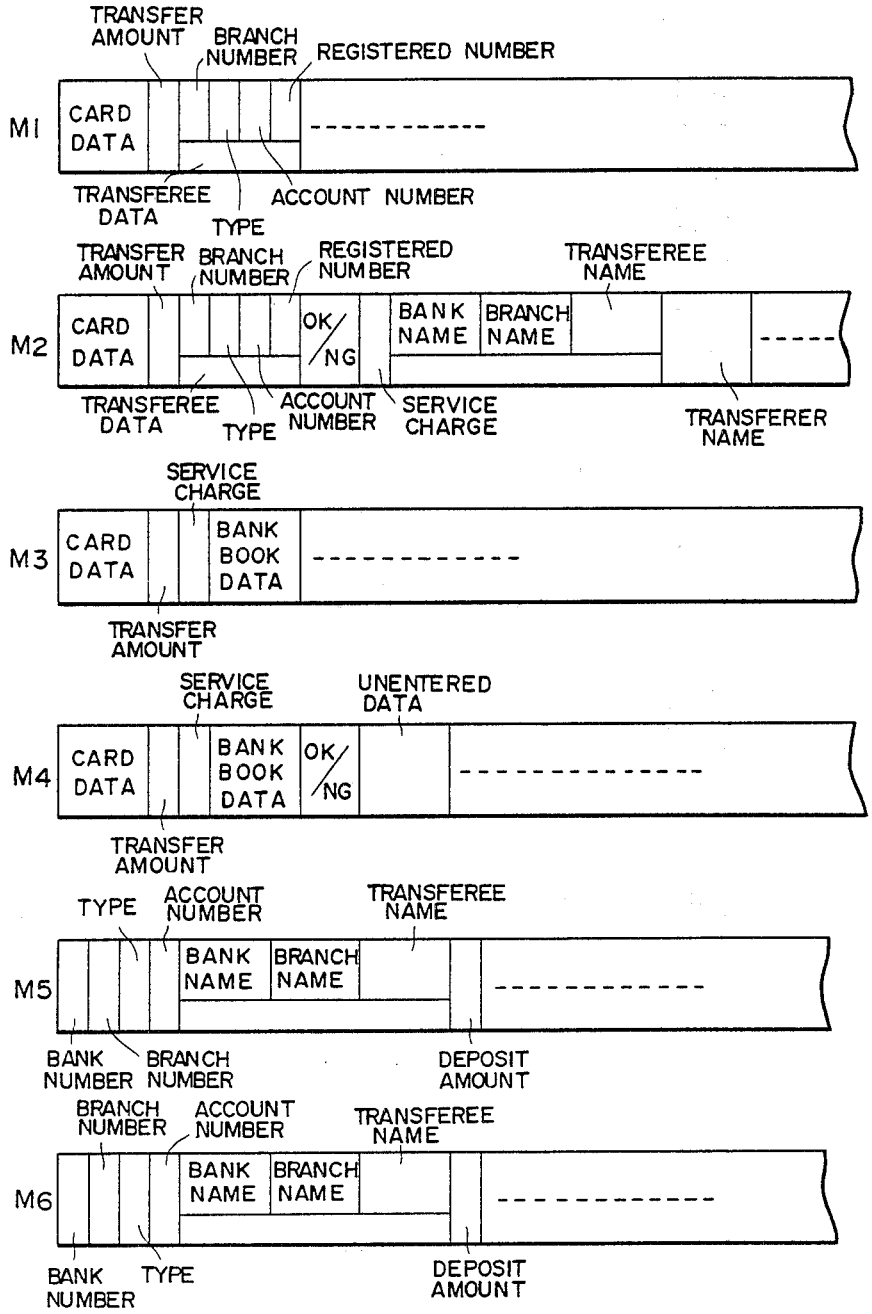
FIG. 11 illustrates formats for messages conversed between a center unit and the automatic banking system of the present invention.

Thus, returning to FIG. 12B, the data specifying the accounts of transferer and transferee and the transfered monetary amount are entered into the terminal 1 by the customer, these data are transmitted to the center unit (step 133). A message about the transaction information to be transmitted to the center unit is exemplarily illustrated in FIG. 11 as message M1. The message M1 consists of the transferer's card data, the transferred monetary amount, the transferee's data and other reference information. The transferee's data includes the branch number, account type and account number which have been entered in the steps 121 to 127 or by reading the card data of transfer card, or the registered number which has been entered in the step 130. Unless there exists the registered number, the data for the registered number is set to a "0" data. If the transferee's data is a registered number, the registered number file in the center unit is searched to read out the bank number, branch number, account number and account type of the transferee. On these read out transferee's data or the transferee's data included in the transaction information message M1, if the transferee's account belongs to the customer's bank, the customer information file in the customer's bank is searched for the transferee. Or, if the transferee's account belongs to another bank, a customer information file in the another bank is called so as to find the details of the transferee's account. Based on the results of such search operation, a message M2 of FIG. 11 is made in the center unit. The message M2 includes the contents of the message M1, the data if the transfer transaction is available, service charge, the bank name branch name of the transferee's account, the transferee's and transferer's names, and other information. The case in which the transfer transaction is not available is such that there does not exist the transferee's account, that is, a center rejection.

Figure 25:
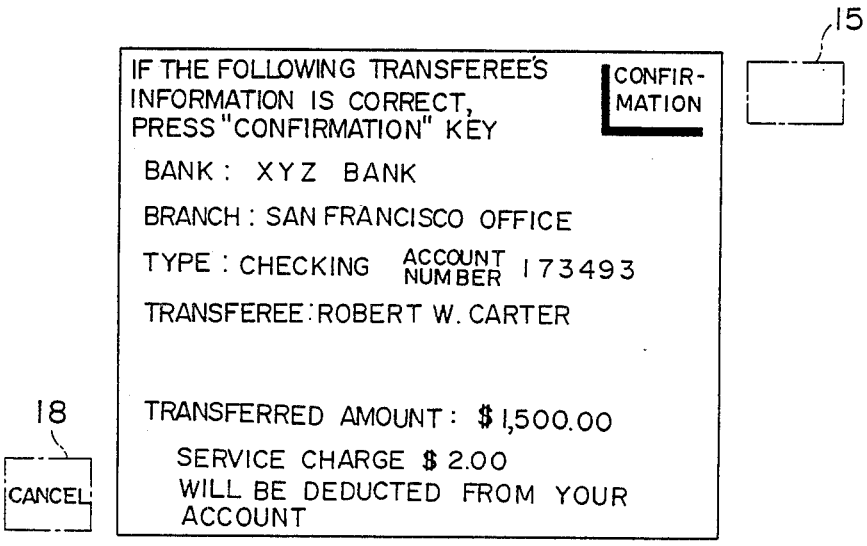
Figure 26:
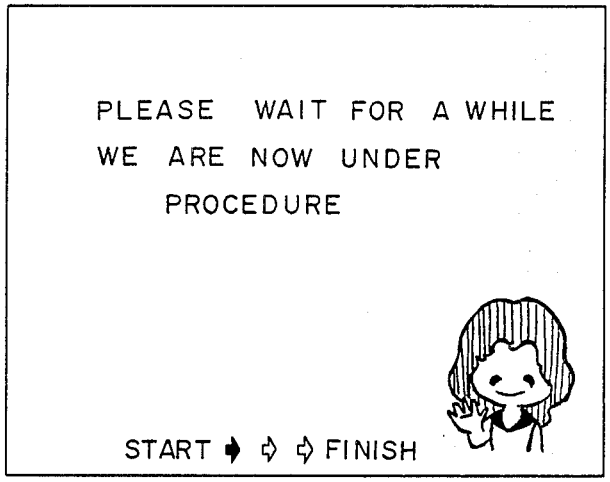
Figure 27:
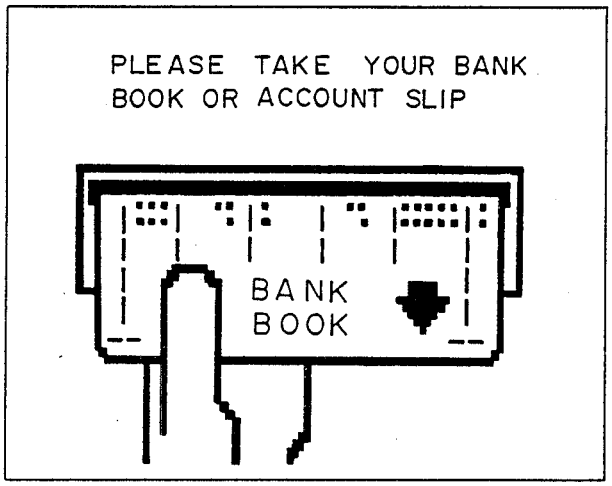

If the terminal 1 receives the message M2 from the center unit (step 134), it is inquired if it includes center rejection (step 135). Unless the message M2 includes such center rejection, viz. on a "NO" response to the step 135, an instructive message shown in FIG. 25 is displayed on the CRT 2 to instruct the customer to confirm if the transaction information is correct (step 136). The transaction information displayed on the CRT 2 includes the bank name, branch name, account type and account number of the transferee's account, the transferee's name, the transferred monetary amount, the service or handling charge, and so forth, which are based on the information transmitted from the center unit. The switch 15 is used as a confirmation key. If the customer reads the displayed message and presses the confirmation key 15 (step 137), a waiting message illustrated in FIG. 26 is displayed on the CRT 2 (step 138) and the sequence flows to steps for a transfer transaction.

If the message from the center unit includes the center rejection in the step 135 or the cancel key switch 18 illustrated in FIG. 25 is pressed in step 151, the inserted card and bank book are dispensed, together with detailed account slip, to the customer for finishing the whole operations (step 152).

To perform transfer operations, initially, a transfer message M3 illustrated in FIG. 11 is made for transmission to the center unit (step 139). The data M3 includes card data, amount of money to be transferred, service charge, bank book data, and so forth. The summed up amount of the transferred money and the service charge is deducted from the customer's account. On reception of the transfer message, the center unit performs the operations that the withdrawal amount is withdrawn from his account and, as a result, a message M4 is made for transmission to the terminal 1.

The message M4 includes the contents of the message M3, the data representing if there is a center rejection, unentered information and so forth. The center rejection represents the status that the balance of the transferer's account is smaller than the withdrawal amount and the withdrawal operation is not available.

On reception of the center message M4 (step 140), the bank book or detailed account slip is printed with such transfer transaction data (step 141), an instructive message to instruct the transferer to receive the bank book or account slip is displayed on the CRT 2 (step 142), and the bank book or slip is dispensed to him (step 143). If there is found the center rejection in the step 140, the sequence flows to the step 152 (this sequence is not shown in the drawings).

Figure 28:
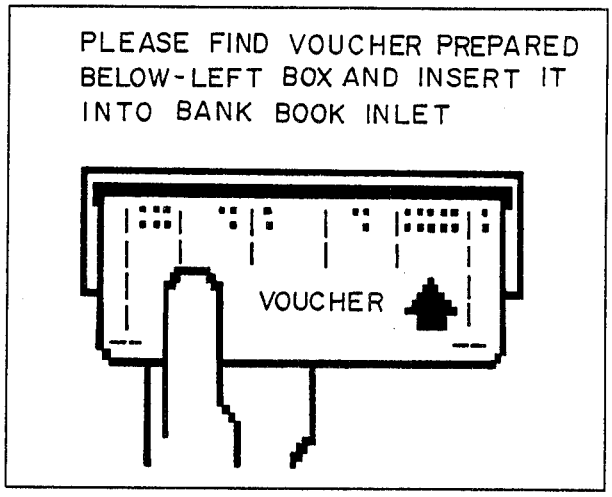
Figure 29:
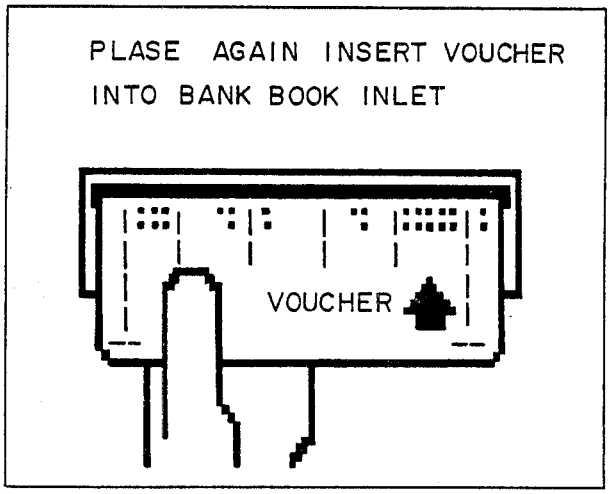

After the step 143, an instructive message shown in FIG. 28 to instruct the customer to take one voucher 27 from the holder 10 and insert it into the bank book inlet 3 is displayed on the CRT 2 so as to print the results of the transfer transaction on the inserted voucher 27 (step 144). If the customer inserts the taken voucher 27 from the holder 10 into the inlet 3 (step 145), the inserted voucher 27 is conveyed within the terminal 1 so that the voucher code K3 is read by the code detector 37 to verify the genuineness of the code K3 (step 146). If the voucher code K3 is verified to be genuine, it is inquired in response to the outputs developed from the detector 37 if print finish mark K4 exists (step 147). Upon a "NO" response to the step 147, the transfer transaction data are printed on predetermined columns of the voucher 27 (step 148). If voucher code K3 does not exist or is not genuine, a "NO" response is made in the step 146 to represent that other document than voucher 27 is inserted. A "YES" response to the step 147 represents that the inserted voucher has been already printed in a former transaction. Upon the "NO" response to the step 146 or 147, an instructive message shown in FIG. 29 is displayed on the CRT 2 to instruct the customer to again insert another voucher (step 149), the previously inserted other document or voucher is dispensed through the inlet 3 to the customer (step 150), and the sequence returns to the step 145. Thus, it can be avoided that a wrong paper other than the voucher is printed or a previously printed voucher is again printed by customer's erroneous operations.

Figure 30:
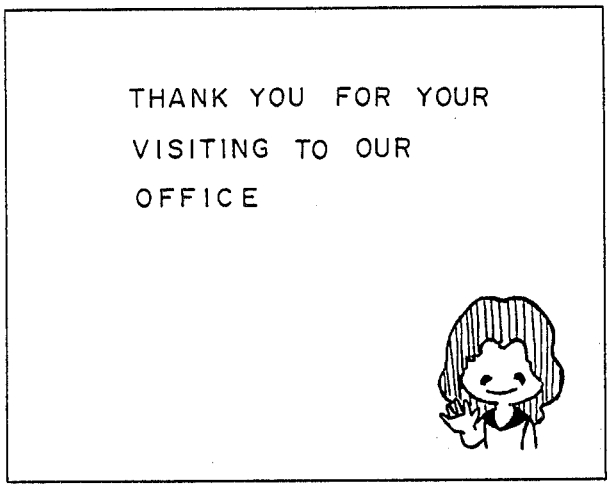

Finally, a message M5 illustrated in FIG. 11 is made, and transmitted to the center unit, the message M5 comprising the transferee's data (bank number, branch number, account number, account type and so forth) and the amount of transferred money (deposited amount) (step 153). Upon receiving the message M5, the center unit performs a transaction that the transferred monetary amount is deposited to the transferee's account and a similar message M6 illustrated in FIG. 11 is transmitted to the terminal 1. On reception of the message M6 (step 154), an instructive message is displayed on the CRT 2 to instruct the customer to receive his card (step 155), the card is dispensed to him (step 156), an instructive message is displayed on the CRT 2 to instruct him to receive voucher (step 157), the voucher is dispensed through the inlet 3 to him (step 158), a finish message illustrated in FIG. 30 is displayed on the CRT 2 (step 159), and the whole sequence is consumated.

The voucher is prepared so as to be printed with the detailed results of a transfer transaction because such a detailed data cannot be printed on bank book or detailed accout slip. Therefore, the customer can record the detailed information his transfer transaction on the voucher.

The automatic banking system in this embodiment performs a transaction for transferring funds between two accounts, but may be modified in such a manner that the moneies deposited into the transaction terminal in cash are transferred to a predetermined accout. The transfer transactions are performed on a telecommunication basis, but if desired, may be modified to be performed on a decument basis. In such a modification, the operation switches 15 and 17 may be selectively used, together with the CRT 2, so as to designate telecommunication or document transaction. Generally, the service charges for telecommunication and document basis transactions have different charges, respectively.

Returning to FIG. 13, another transactions for deposit, withdrawal, entry and balance reference to be performed by the automatic banking system in this embodiment will be explained hereinafter.

If the switch 16 (see FIG. 14) is pressed to designate a deposit transaction, an instructive message is displayed on the CRT 2 to instruct the customer to insert his card or bank book (step 181). Deposit transactions in this embodiment are activated by accepting either bank book or card. If the customer inserts his bank book into the bank book inlet 3 (step 182) or his bank card into the card inlet 5.(step 183), an instructive message to the customer for depositing monies is displayed on the CRT 2 (step 184). If the customer inserts into the cash inlet 7 the bank notes to be deposited (step 185), the deposited bank notes are sensed (step 186) and retained in a temporary storage mechanism. The information of the sensed bank notes is displayed on the CRT 2 for confirmation by him about the amount of his deposited monies (step 187). If he presses the switch 15 designated as a confirmation key (step 188), a waiting message is displayed on the CRT 2 (step 189). Then, a detailed account slip is printed, a deposit message for transmission to the center unit is made and other remained operations are performed so as to perform a predetermined deposit operation (step 190). Then, the sequence flows to a step 191 in which the terminal is conversed with the center unit.

If a descending message transmitted from the center unit includes the data representing that the deposit transaction is acceptable, the inserted bank book (if a card is used for the deposit transaction, a detailed account slip) is printed with date, deposited monetary amount, new balance and so forth (step 192). Then, the bank notes retained in the temporary storage mechanism are stored (step 193). An instructive message to instruct the customer to receive his bank book or card is displayed on the CRT 2 (step 194), his bank book or card and the printed account slip are dispensed to him (step 195), and a finish message for completion of all procedures is displayed on the CRT 2 (step 196).

In a withdrawal transaction, a customer's card is used for verifying his secret number. A bank book may be used together with the card. The CRT 2 displays an instructive message to instruct the customer to insert his card (step 201). If his card is inserted (step 202), the CRT 2 displays a message to instruct him insert his bank book or enter his secret number instead of the insertion of his bank book (step 203). If he inserts his bank book (step 204), the CRT 2 displays an instructive message for entering his secret number (step 205). If his secret number is entered through the ten-key keyboard 6 (step 206) and the entered number is verified to be genuine, the CRT 2 displays an instructive message for entering the amount of money to be withdrawn (step 207). If he enters the withdrawal amount through the keyboard 6 (step 208), the CRT 2 displays a waiting instructive message (step 209). Then, a withdrawal operation such as making a message to be transmitted to the center unit is performed (step 210), and the sequence flows to a step 211 for conversing with the center unit.

If the withdrawal transaction is accepted as a result of such conversion with the center unit, his bank book or a detailed account slip is printed with the results of the withdrawal transaction (step 212), the CRT 2 displays an instructive message to the customer for receiving his bank book or card (step 213). If the bank book or card is dispensed (step 214) and he pulls it out, the CRT 2 displays an instructive message for receiving monies (step 215) and cash with the detailed account slip is dispensed to him (step 216). Then, the CRT 2 displays a message for illustrating the completion of the transaction (step 217).

In an entry transaction, a customer's bank book is printed with the current details of his account.

Initially, in the entry transaction designated in the step 102, an instructive message to the customer for inserting his bank book is displayed on the CRT 2 (step 221). If he inserts his bank book (step 222), the CRT 2 displays a waiting instructive message (step 223). Then, predetermined operations for entry transaction are performed (step 224), the sequence flows to a step 225 for conversing with the center unit. On reception of the entry information data transmitted from the center unit, the inserted bank book is printed with the received entry information data (step 226). Then, the bank book is dispensed to him (step 228), the CRT 2 displays the completion of the transaction (step 229), and the whole sequence is finished.

In a balance reference transaction, the CRT 2 displays an instructive message for instructing the customer to insert his card (step 241), and in response to the insertion of his card (step 242), displays an instructive message for entering his secret number (step 243). If the secret number is entered through keyboard 6 (step 244) and the entered number is verified to be correct, the CRT 2 displays a waiting instructive message (step 245). Then, predetermined operations for the balance reference are performed (step 246), and transaction processing data are conversed with the center unit (step 247). Upon receiving the balance information of his account, the information is printed on a detailed account slip (step 248) and the CRT 2 displays an instructive message for receiving his card (step 249). The card and account slip are dispensed so as to be taken by the customer (step 250), and the CRT 2 displays an end message (step 251) for completion of the transaction.

Thus, the automatic banking system according to the present invention is very advantageous for transfer transactions. The center unit of the system has a storage means for registering data regarding the transferer's and transferee's accounts so that upon just entry of a registered number, the transferee's account corresponding to the registered number may be designated even if the account is another bank's account, whereby the operations by a user for transfer transactions are simplified.

Moreover, since the system has means for checking the data in the transaction terminal with the center unit, the transactions are performed with high reliability. The automatic banking system has means for rejecting improper document erroneously inserted by customers in a procedure step for printing transfer transaction data on a voucher, whereby precise printing operations can be assured.

Although the terminal in the foregoing description is operated by a customer, it is to be appreciated that the terminal may also be used by bank personnel and that the terminal may be used for other functions other than banking transactions. It will be apparent that various further modifications are possible without departing from the scope of the appended claims.

We claim as our invention:

1. An automatic banking system comprising registered number file means for storing data as to transferer's and transferee's accounts as a registered number for each pair of transferer and transferee account, selecting means for being selectively actuated by a user to designate if a transferee's account is registered in said registered number file means, input means for entering a registered number, and means for searching said registered number file means to find the transferee's account corresponding to said registered number entered through said input means by the user and read detailed data of said found transferee's account.

2. An automatic banking system according to claim 1, wherein said system consists of a transaction terminal and a center unit, said registered number file means being comprised in the center unit.

3. An automatic banking system according to claim 1, wherein said input means is a ten-key keyboard.

4. An automatic banking system according to claim 1, wherein said input means is a card reader for reading a registered number recorded on a user's card.

5. An automatic banking system according to claim 1 further comprising means for if said selecting means is activated to designate that the transferee's account is not registered, allowing data about the transferee's account to be entered by the user.

6. An automatic banking system according to claim 1 further comprising sensing means for sensing if a print end mark is printed on a voucher and printing means for if said sensing means does not sense the print end mark, printing transaction data and a print end mark on the voucher.

7. An automatic banking system according to claim 1 further comprising means for verifying the genuineness of a voucher to be printed with transaction data.

8. An automatic banking system according to claim 1, wherein said system including a transaction terminal operated by a user, said terminal including means for holding a plurality of vouchers to be taken out by the user.

* * * * *